US008777210B2

(12) United States Patent
Miwa

(10) Patent No.: US 8,777,210 B2
(45) Date of Patent: Jul. 15, 2014

(54) IMAGE FORMATION DEVICE

(75) Inventor: Atsushi Miwa, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 245 days.

(21) Appl. No.: 13/076,903

(22) Filed: Mar. 31, 2011

(65) Prior Publication Data

US 2012/0056970 A1 Mar. 8, 2012

(30) Foreign Application Priority Data

Sep. 2, 2010 (JP) ..... 2010-196477

(51) Int. Cl.
*B65H 5/00* (2006.01)

(52) U.S. Cl.
USPC ..... 271/10.03

(58) Field of Classification Search
USPC ..... 271/110, 270, 10.03, 258.01, 258.02, 271/265.01, 265.02
See application file for complete search history.

(56) References Cited

U.S. PATENT DOCUMENTS

| | | | | |
|---|---|---|---|---|
| 4,234,179 | A * | 11/1980 | Weir | 493/14 |
| 5,464,204 | A | 11/1995 | Suzuki | |
| 5,978,612 | A | 11/1999 | Suzuki et al. | |
| 2007/0001388 | A1 * | 1/2007 | Able et al. | 271/258.01 |

FOREIGN PATENT DOCUMENTS

| | | | |
|---|---|---|---|
| JP | HEI 1-157858 | A | 6/1989 |
| JP | HEI 6-219601 | A | 8/1994 |
| JP | HEI 8-179577 | | 7/1996 |
| JP | 2001-341865 | A | 12/2001 |
| JP | 2003-040466 | A | 2/2003 |
| JP | 3610104 | B2 | 10/2004 |
| JP | 2006-256796 | * | 9/2006 |
| JP | 2006-298587 | A | 11/2006 |

OTHER PUBLICATIONS

Machine ttranslation of JP2006-256796.*
Notification of Reasons for Rejection dated May 8, 2012 received from the Japanese Patent Office from related Japanese Application No. 2010-196477, together with an English-language translation.
Abstract only of JP 8179577 A, (for document dated Jul. 12, 1996).

* cited by examiner

*Primary Examiner* — Thomas Morrison
(74) *Attorney, Agent, or Firm* — Scully, Scott, Murphy & Presser, P.C.

(57) ABSTRACT

An image formation device is configured such that a length of a sheet feed path from a sheet accommodation unit to a sheet detection unit is greater than the sheet distance for a predetermined type sheet that has substantially the same sheet length as a maximum size sheet employable in the image formation unit. A sheet length of the sheet fed by the sheet feed mechanism is measured. If the sheet length of a firstly fed sheet, which is fed in response to an image formation instruction and measured by the measuring unit, is equal to the sheet length of the predetermined type of sheet, the control unit feeds a subsequent sheet with the sheet distance corresponding for the maximum size sheet between a trailing end of the previously fed sheet and the leading end of the subsequent sheet.

9 Claims, 8 Drawing Sheets

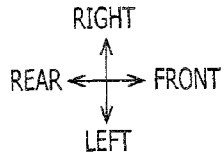
FIG. 3A
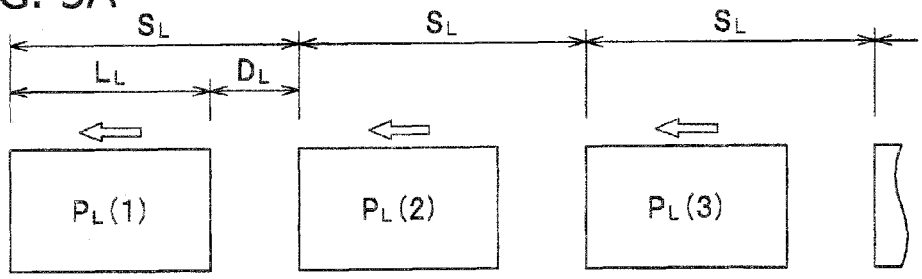
FIG. 3B
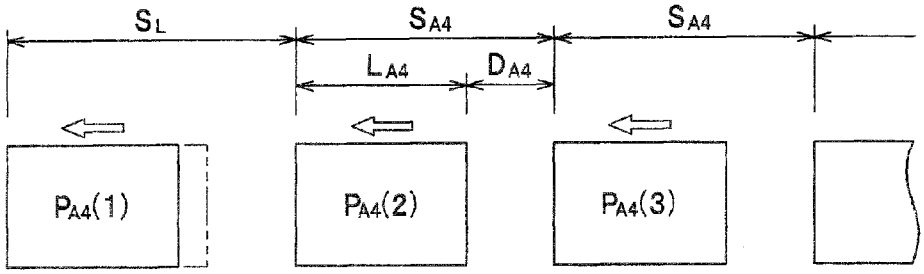
FIG. 3C
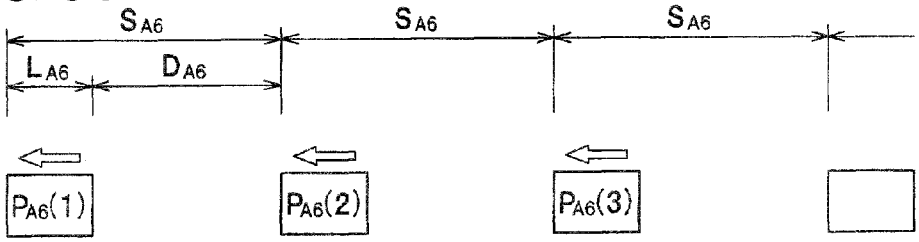
FIG. 3D
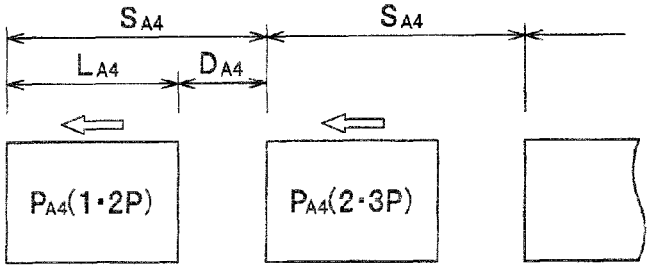

IMAGE FORMATION DEVICE

CROSS-REFERENCE TO RELATED APPLICATION

This application claims priority under 35 U.S.C. §119 from Japanese Patent Application No. 2010-196477, filed on Sep. 2, 2010, which was filed based on Japanese Patent Application No. 2009-297793, filed on Dec. 28, 2009. The entire subject matters of the applications are incorporated herein by reference.

BACKGROUND

1. Technical Field

Aspects of the present invention relate to an image formation device, and particularly to an image formation device capable of feeding a plurality of sheets, which are accommodated in an accommodation unit, subsequently and one by one to an image formation unit.

2. Related Art

Generally, the image formation device such as a printer is configured such that a plurality of sheets are accommodated in a sheet cassette, a sheet tray or a manual insertion tray, and a sheet feed timing is controlled so that the sheets are fed one by one, subsequently. When the size (in this specification, "size" mostly means a length in a sheet feed direction) of the sheets is known (e.g., designated by a user), the timing control is executed such that the image formation device feeds a second sheet based on the size of the sheet. If the size of the sheet is not known, the timing control is executed such that the second sheet is fed based on the maximum size the image formation device can use. Typically, when the second sheet is fed, the size of the sheet is measured. Therefore, when the third sheet is fed, the timing control is executed based on the measured size of the sheet.

SUMMARY

As described above, according to the conventional image formation device, if the sheet size is not designated, whichever sheets are used, the timing control is executed based on the maximum sheet size when the second sheet is fed. Therefore, if the size of the sheet actually fed is considerably small in comparison with the maximum size, an unnecessary long period is elapsed for processing the second sheet.

In view of the above, aspects of the present invention is advantageous in that an improved image formation device is provided, which includes a sheet accommodation unit configured to accommodate any one of a plurality of types of sheets having different sheet lengths, an image formation unit configured to form an image of the sheet, a sheet feed mechanism configured to feed the sheet accommodated in the sheet accommodation unit toward the image formation unit, a feed path that guides the sheet fed by the sheet feed mechanism to the image formation unit, a sheet detection unit provided to the sheet feed path and configured to detect absence/presence of the sheet, a control unit configured to control the sheet feed mechanism such that, when a plurality of sheets are fed and images are formed on the plurality of sheet, respectively, the control unit controls the sheet feed mechanism to feed the plurality of sheet one by one with a predetermined sheet distance therebetween, the predetermined sheet distance corresponding to the size of the plurality of the sheets.

A length of the sheet feed path from the sheet accommodation unit to the sheet detection unit is greater than the sheet distance for a predetermined type sheet that has substantially the same sheet length as a maximum size sheet employable in the image formation unit. The control unit comprises a measuring unit configured to measure a sheet length of the sheet fed by the sheet feed mechanism based on movement of the sheet and an output of the sheet detection unit. Further, if the sheet length of a firstly fed sheet, which is fed in response to an image formation instruction measured by the measuring unit, is equal to the sheet length of the predetermined type of sheet, the control unit feeds a subsequent sheet with the sheet distance corresponding for the maximum size sheet between a trailing end of the previously fed sheet and the leading end of the subsequent sheet.

BRIEF DESCRIPTION OF THE ACCOMPANYING DRAWINGS

FIGS. 3A-3D show a timing chart illustrating a timing control of the sheet feed according to the embodiment of the invention.

Figure 4:
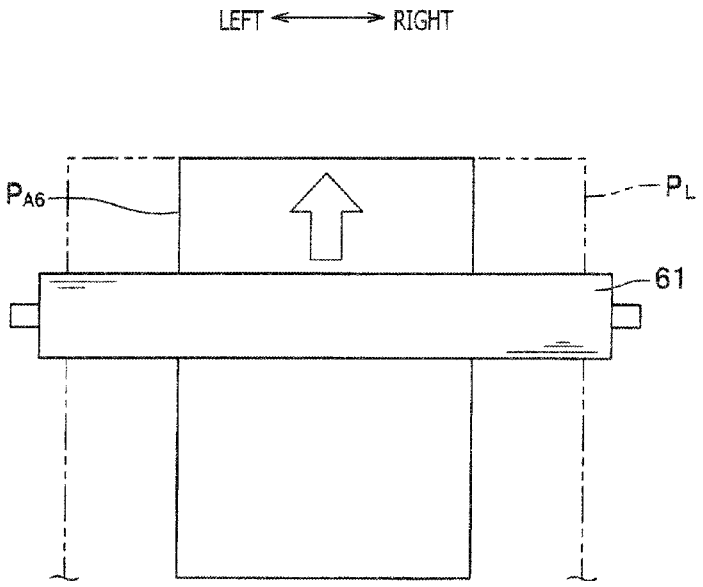

FIG. 4 a plan view of a fixing unit for illustrating a reason why an interval between sheets having a small width is relatively large.

Figure 5:
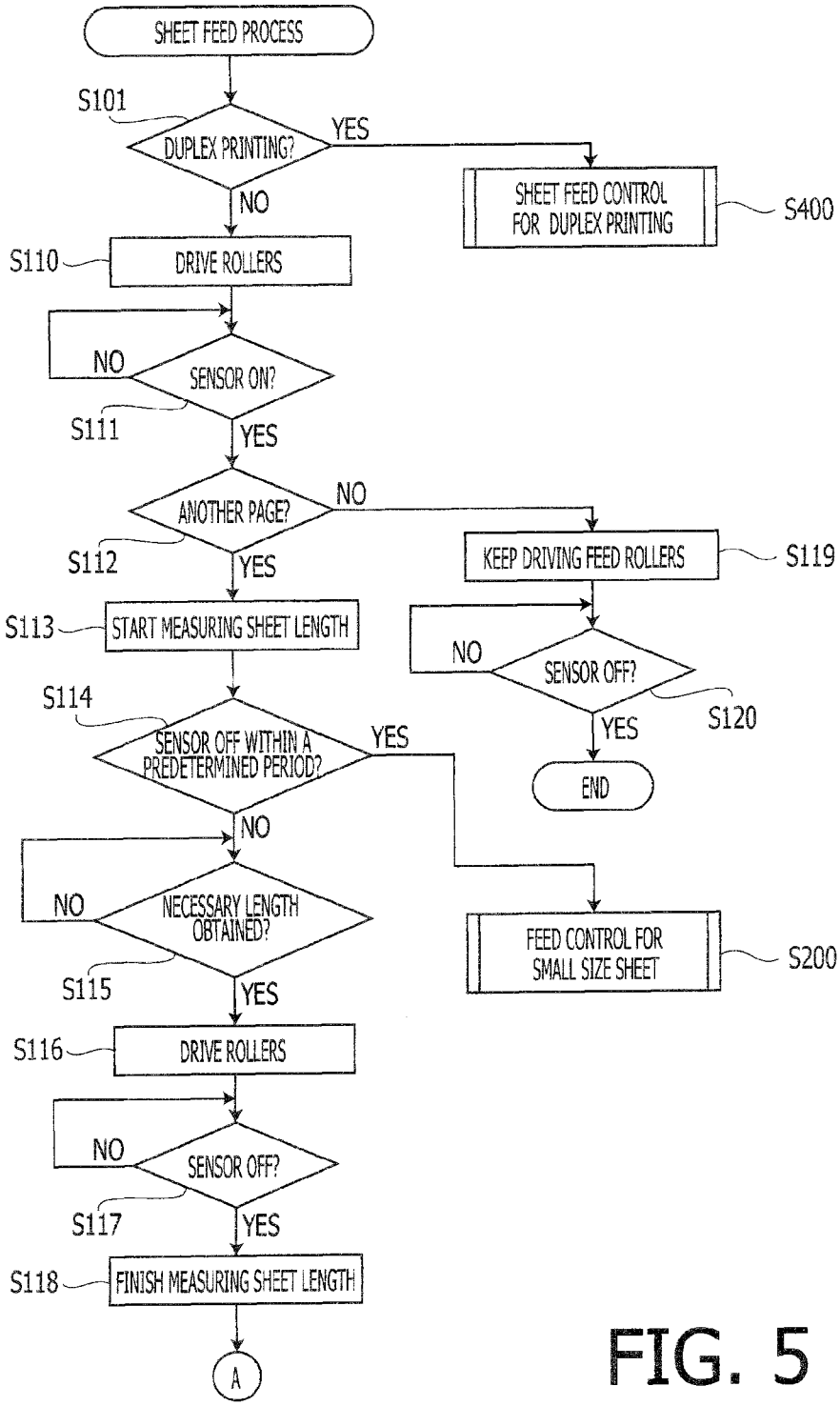
Figure 6:
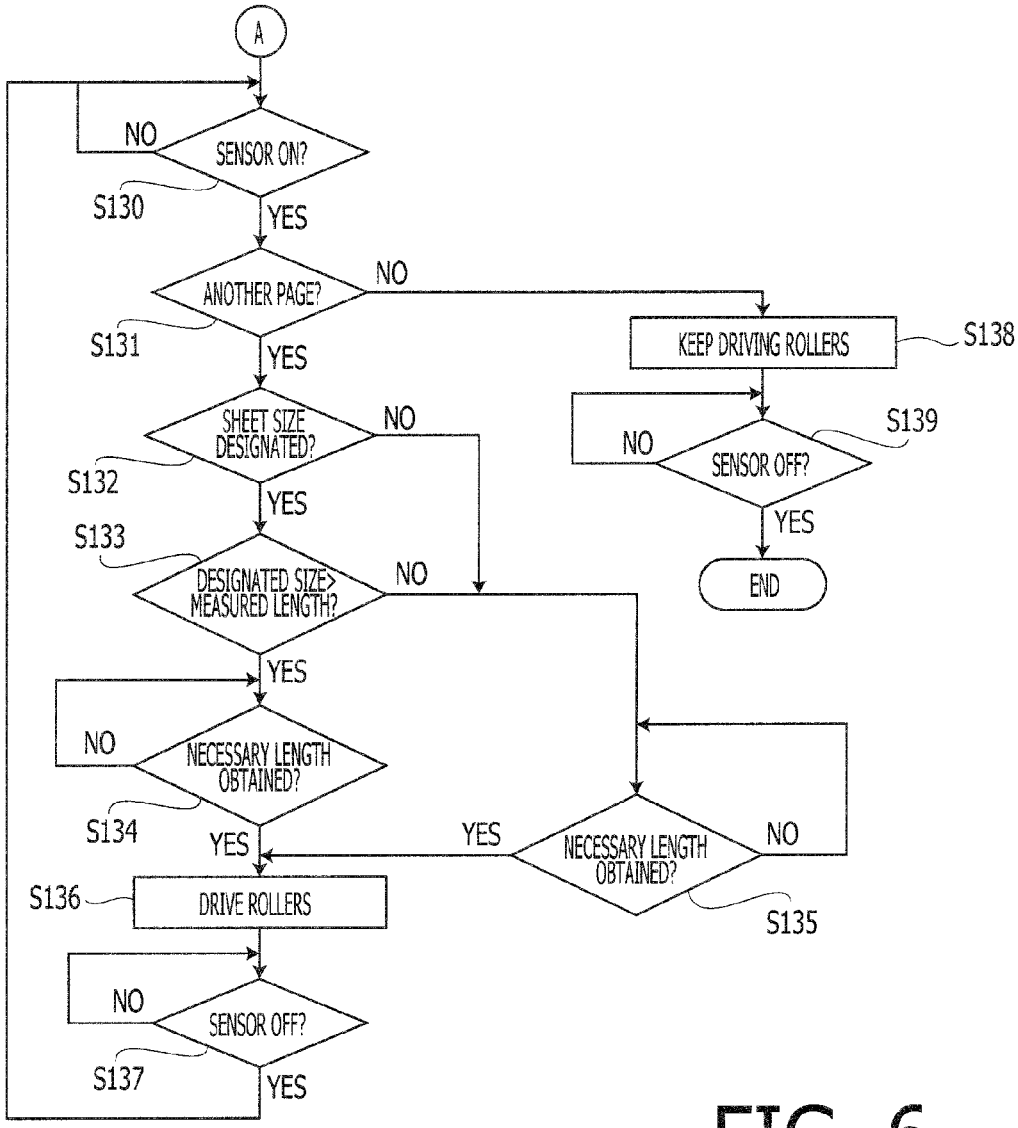

FIGS. 5 and 6 show a flowchart illustrating a sheet feed process according to the embodiment of the invention.

Figure 7:
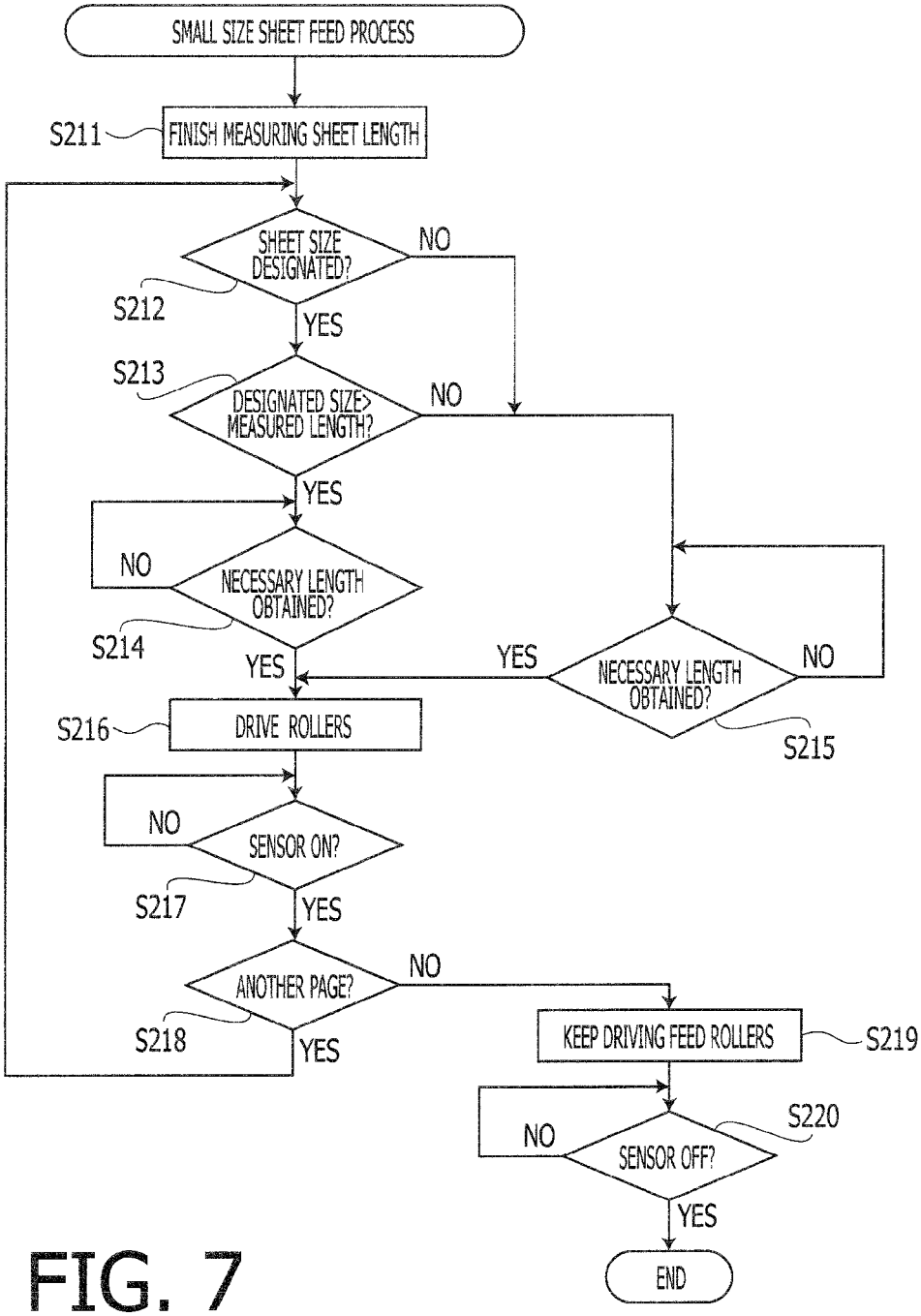

FIG. 7 shows a flowchart illustrating a sheet feed process when a small size sheets are fed.

Figure 8:
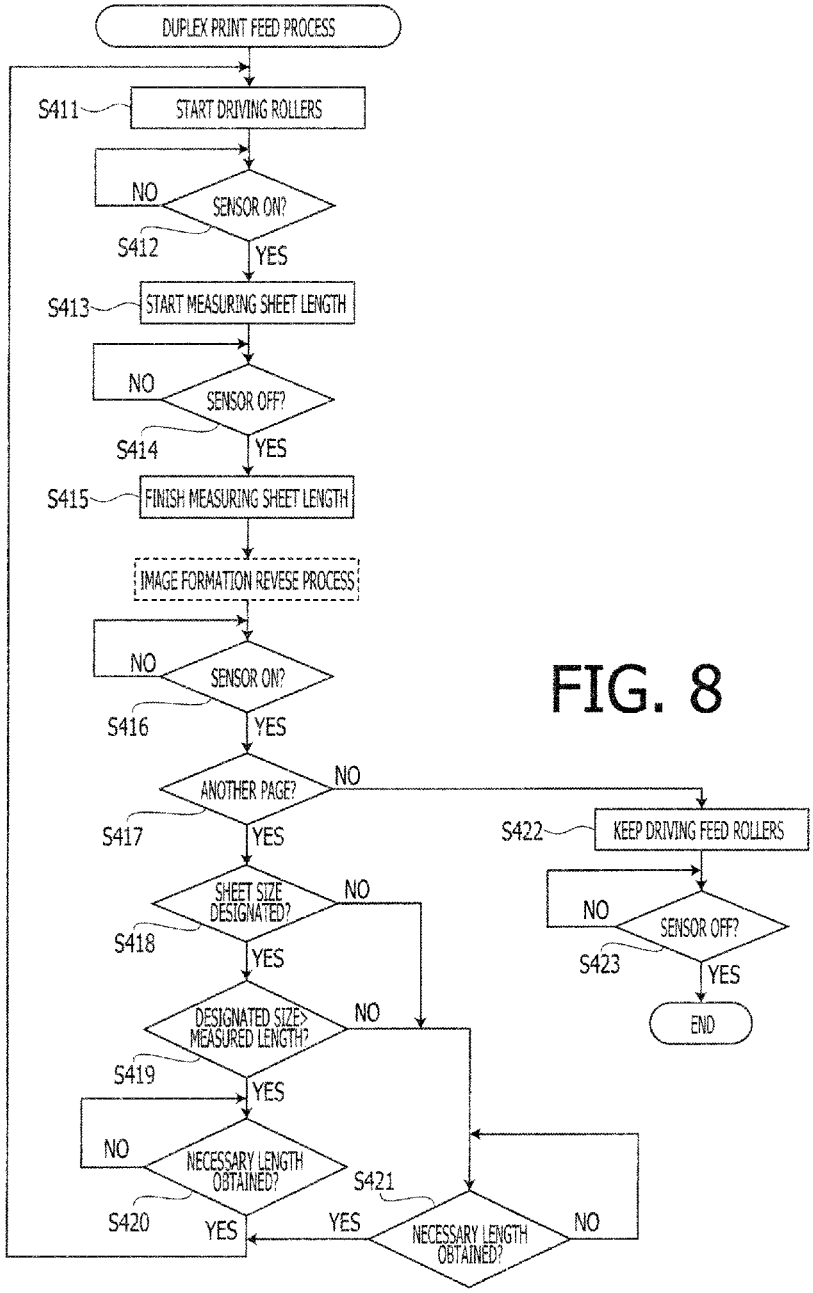

FIG. 8 shows a flowchart illustrating a sheet feed process when a duplex printing is executed.

DETAILED DESCRIPTION

Figure 1:
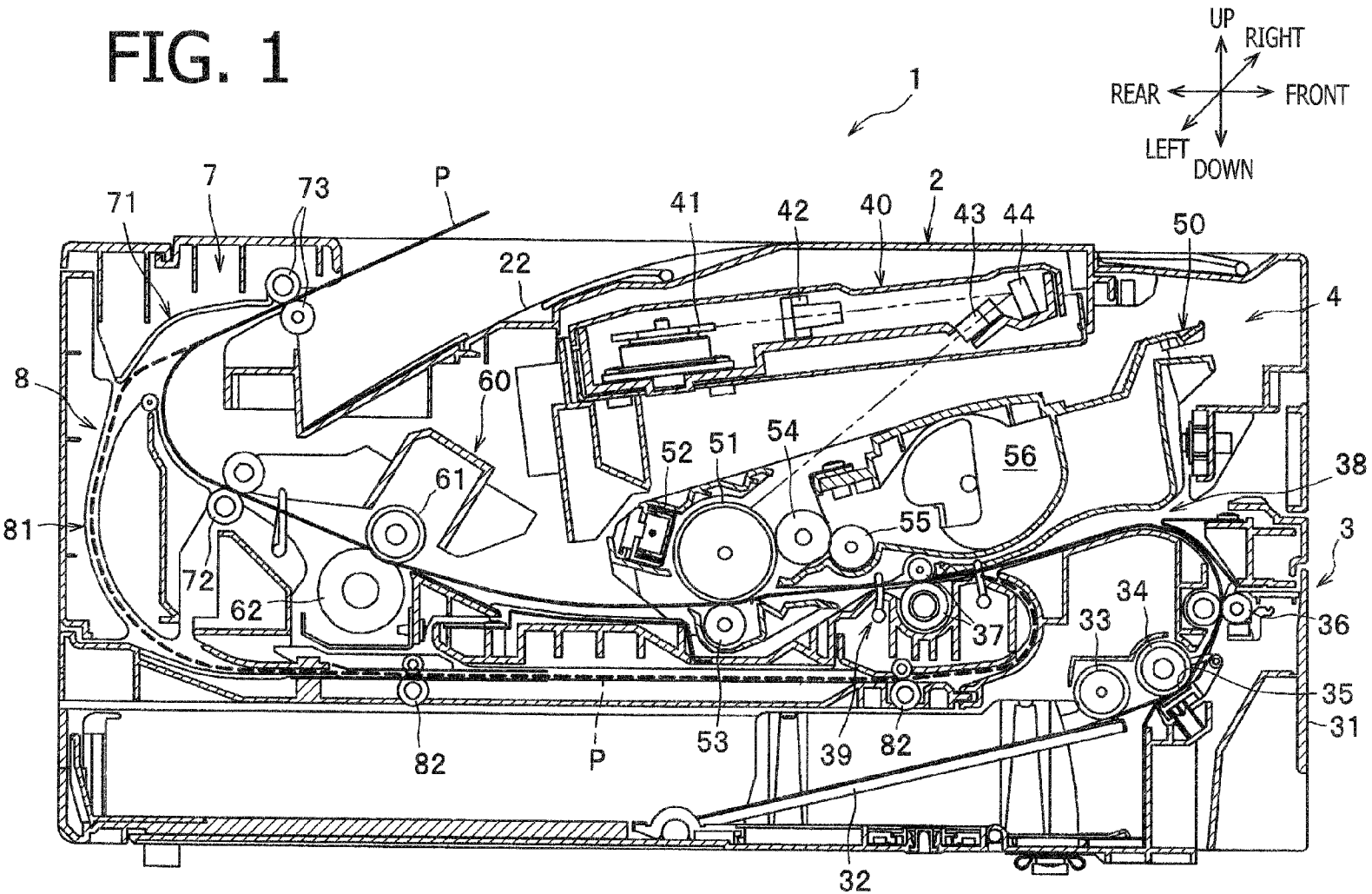
FIG. 1 is a cross-sectional side view of a laser printer according to an embodiment of the invention.

Hereinafter, an exemplary embodiment according to aspects of the present invention will be described with reference to the accompany drawings. In the following description, directions are indicated as ones viewed by a user of a laser printer 1. That is, a right-hand direction, a left-hand direction in FIG. 1 are a "front" direction and a "rear" direction of the laser printer 1, respectively. The other directions are defined similarly.

The laser printer 1 is configured to execute a simplex printing or a duplex printing. The laser printer 1 has, inside a housing 2, a sheet feed unit 3, an image formation unit 4, a discharge unit 7, and a reverse unit 8.

The sheet feed unit 3 is for supplying a sheet P to the image formation unit 4. At a lower portion of the housing 2, a sheet accommodation unit is provided. The sheet accommodation unit is configured to accommodate recording sheets P such as printing sheets, OHP sheets or the like. According to the embodiment, as the sheet accommodation unit, a sheet tray 31 is provided. The sheet feed unit 3 further includes a sheet feed mechanism which feeds the sheets P accommodated in the sheet tray 31 toward the image formation unit 4. For guiding the sheets fed by the sheet feed mechanism to the image formation unit 4, a feed path 38 is defined. The sheet feed mechanism includes a pickup roller 33 which contacts the sheet P in the sheet tray 31, a separation roller 34, and sheet feed rollers 36 and 37.

The feed path 38 is a path configured to guide the sheet P fed by the pickup roller 33 toward the image formation unit 4, more specifically, to a nip between a photoconductive drum 51 and a transfer roller 53. The feed path 38 extends, from a vicinity of the sheet tray 31, in an upper front direction. Then, the feed path 38 is bent rearward and directed to the nip between the photoconductive drum 51 and the transfer roller 53.

The sheets P accommodated in the sheet tray 31 are urged toward the pickup roller 33 by a pressure plate 32. When the pickup roller 33 is driven to rotate, the top sheet P in the sheet tray 31 is fed. By the separation roller 34 and the separation pad 35, even if a plurality of sheets P are picked up, one sheet P is separated from the others. Then, the separated sheet P is fed by the sheet feed rollers 36 and 37 and directed to the image formation unit 4. The sheet feed rollers 36 and 37 include a feeding roller 36 located on an immediate downstream side of the separation roller 34, and a register roller 37 located on a downstream side of the feeding roller 36 and on an upstream side of the photoconductive drum 1. The sheet P fed by the feeding roller 36 is abut against the register roller 37 which is stopped or reversely rotated, thereby a leading end of the sheet P being prevented from moving further. With this configuration, a so-called skew of the sheet P is prevented/corrected. Thereafter, the register roller 37 is forwardly rotated to further feed the sheet P toward the nip between the photoconductive drum 51 and the transfer roller 53.

The pickup roller 33, the separation roller 34, the feeding roller 36 and the register roller 37 are driven by a single motor, and selectively rotated or stopped with use of clutch mechanisms and the like. Since such mechanisms have been known conventionally, detailed description there of are omitted for brevity. It is of course possible to modify such a configuration so that the rollers are driven by different motors, respectively. Incidentally, the register roller 37 may be a normal roller such as the feeding roller which does not have a register function.

The image formation unit 4 is for forming an image according to an electrophotographic image formation method on a sheet P fed from the sheet feed tray 31. According to the embodiment, the image formation unit 4 is arranged above the sheet feed tray 31. The image formation unit 4 has an exposure unit 40, a process cartridge 50 and a fixing unit 60.

The exposure unit 40 is arranged above the process cartridge 50 and is configured to emit a scanning laser beam that scans on a circumferential surface of the photoconductive drum 51. As shown in FIG. 3, the exposure unit 40 make a laser beam pass through or reflect a revolving polygonal mirror 41, a lens 42, a mirror 44 and a lens 43 so that the scanning beam is incident on the photoconductive drum 51.

The process cartridge 50 is provided with the photoconductive drum 51, a charger 52, a transfer roller 53, a developing roller 54, a feed roller 55 and a toner container 56 that contains toner therein.

The fixing unit 60 is arranged on the downstream side, in the sheet feed direction, with respect to the process cartridge 50, and is provided with a heat roller 61 and a pressure roller 62 which is arranged to face and urged toward the heat roller 61.

In the image formation unit 4, the circumferential surface of the photoconductive drum 51 is uniformly charged by the charger 52, and then exposed to the scanning beam emitted by the exposure unit 40 so that an electrostatic latent image is formed thereon. The toner contained in the toner container 56 is supplied to the developing roller 54 via the feed roller 55 and held thereon.

When the toner carried by the developing roller 54 is supplied to the latent image formed on the photoconductive drum 51, the toner is selectively attracted and the latent image is developed, that is, a toner image corresponding to the latent image is formed on the photoconductive drum 51. Thereafter, as the sheet P fed from the feeding unit 3 passes through the nip between the photoconductive drum 51 and the transfer roller 53, the toner image on the photoconductive drum 51 is transferred onto the sheet P. Next, the sheet P passes through the nip between the heat roller 61 and the pressure roller 62, thereby the toner on the sheet P is fused and fixed on the sheet P. That is, the toner image transferred on the sheet P is fixed thereon.

The discharge unit 7 has a discharge path 71 along which the sheet P bearing the fixed toner image (i.e., formed image) is fed outside the housing 2, a feed roller 72 and discharge rollers 73 provided to the discharge path 71. The discharge path 71 extends toward upper-rear direction from the vicinity of the outlet of the fixing unit 60 and curves back toward the front direction so that it extends toward the discharge tray 22 formed on an upper surface of the housing 2.

The discharge rollers 73 are configured to rotate, in accordance with a well-known control, in a forward direction for feeding the sheet P toward outside of the housing 2, or in a reverse direction for feeding the sheet P toward the reverse unit 8.

The sheet P having an image formed thereon and discharged from the image formation unit 4 (cf. solid line) is fed, by the feed rollers 72, along the discharge path 71. If the simplex printing is finished or duplex printing is finished, the sheet P is discharged on the discharge tray 22 formed on the housing 2 by the forwardly rotated discharge rollers 73. If the image is formed only one surface when the duplex printing is executed, the sheet P is once fed by the forwardly rotated discharge roller 73 till the trailing end thereof reaches the nip between the discharge rollers 73. Then, the discharge rollers 73 are reversely rotated so that the sheet P is introduced inside the housing 2 and fed toward the reverse unit 8 (cf. broken lines).

The reverse unit 8 has a reverse path 81 and feed rollers 82 arranged along the reverse path 81. The reverse path 81 is for reversing the sheet P and feeding the reversed sheet P to the image formation unit 4 again. The reverse path 81 diverges downward from the discharge path 71, curves frontward and extends between the feed tray 31 and the image formation unit 4. The reverse path 81 further curves upward and converges to the feed path 38 on an upstream side, in the sheet feed direction, with respect to the register roller 37.

Therefore, the sheet P fed by the reversely rotated discharge rollers 73 (cf. broken lines) is fed from the reverse path 81 to the feed path 38 with reversed and then fed toward the image formation unit 4. At the image formation unit 4, an image is formed on a back side of the sheet P. Thereafter, the sheet P is discharged from the discharge unit 7 onto the discharge tray 22.

Figure 2:
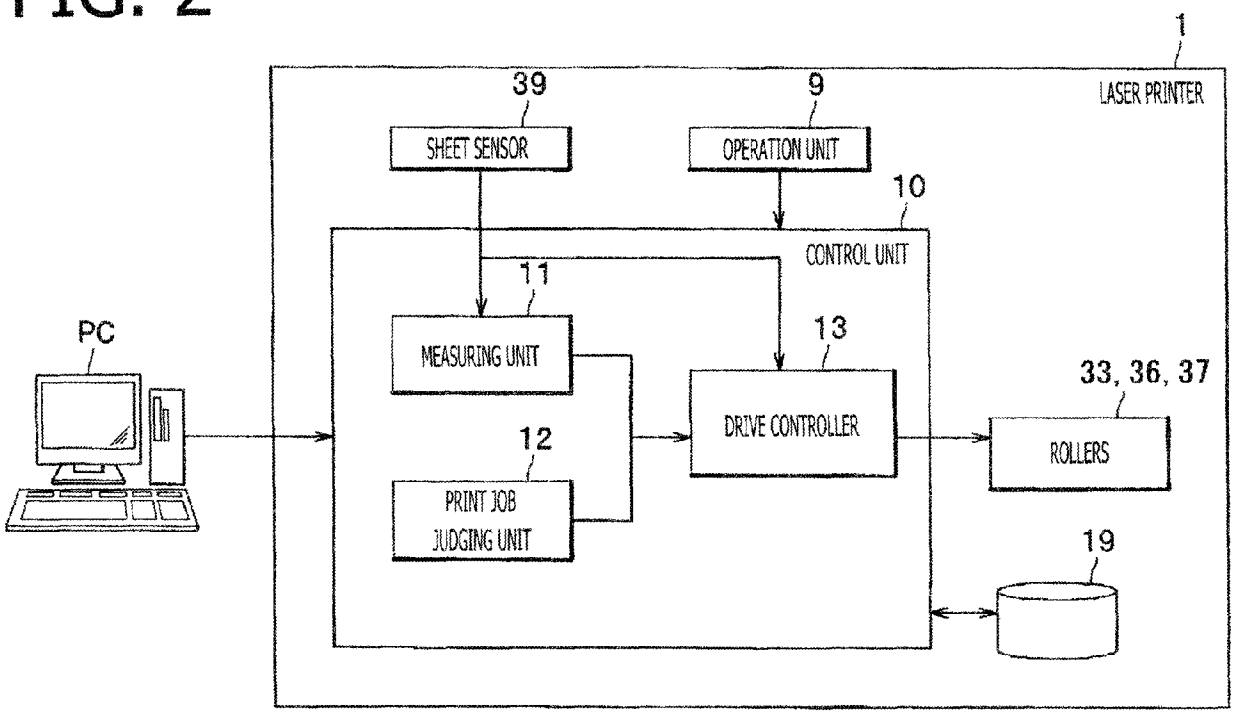
FIG. 2 is a block diagram showing a functional configuration of the laser printer shown in FIG. 1.

A control unit 10 (FIG. 2) controls feeding of the sheets P from the sheet feed tray 31 to the image formation unit 4. Specifically, the control unit 10 controls the pickup roller 33, separation roller 34, feed rollers (i.e., feed roller 36 and register roller 37) to rotate/stop rotating. The control unit 10 operates in association with a controller of the image formation unit 4, and a controller that controls feed roller 72, discharge roller 73 and the feed rollers 82, to execute image formation operation of the printer 1.

Next, the control of maintaining an interval (i.e., sheet distance) between two sheets P when the sheets Pare fed will be described.

A sheet sensor 39 is a well-known sensor which is configured to detect presence/absence of a sheet P in the feed path 38. The sheet sensor 39 is provided on an immediate rear position of the register roller 37, within the feed path 38. The sheet sensor 39 therefore detects a passage of the leading end of the sheet P and a passage of the trailing end of the sheet P.

For example, the sensor 39 has an actuator which rocks when the leading end of the sheet P abuts, and an optical sensor which detects a rocking motion of the actuator.

The sheet sensor 39 may serve as a sensor that is used to control a beam emission timing of the laser emitter of the exposure unit 40. Alternatively, such a sensor may be provided independent of the sheet sensor 39.

The control unit 10 has a measuring unit 11, a print job judging unit 12, and drive controller 13 configured to control operations of a sheet pickup roller 33, a separation roller 34, sheet supplying rollers (i.e., the feed roller 36 and the register roller 37). The control unit 10 includes a CPU (not shown) which controls entire image forming operation of the printer 1, input/output circuits and storage 19 storing various programs. When the CPU executes the programs, various processes as described below are performed.

The measuring unit 11 is configured to measure a length of the sheet P based on the output of the sheet sensor 39. Specifically, the measuring unit 11 measures the length of the sheet P in the sheet feed direction based on a feeding speed of the sheet P within the feed path 38, and a time period from a time when the sheet sensor detects the passage of the leading end of the sheet P to a time when the sheet sensor detects the passage of the trailing end of the sheet P. The sheet size as measured is transmitted to the drive controller 13 as sheet size data.

The print job judging unit 12 judges whether an instruction input by the user regarding the image formation (hereinafter, referred to as a print job) by operating an operation unit 9 of the laser printer 1, through a personal computer or the like, is an instruction to execute a simplex printing (i.e., to print an image on only one side of the sheet P), a duplex printing (i.e., to print images on both sides or the sheet P), and/or a designation of the size of the sheet P. Information regarding the input print job is transmitted to the drive controller 13.

The drive controller 13 controls operations of the feed roller 33, feed rollers (i.e., the feed roller 36 and the register roller 37) based on the outputs of the sheet sensor 39, the measuring unit 11, the print job judgment unit 12 and the like. The drive controller 13 subsequently feeds the sheets P accommodated in the sheet tray 31, toward the image formation unit 4, one by one at a predetermined timing so that a predetermined distance (sheet distance) is maintained between the trailing end of a previously fed sheet P and the leading end of a subsequently fed sheet P.

Specifically, as shown in FIG. 3A, when the sheet P having the maximum length for the laser printer 1 is employed (such a sheet will be referred to a sheet $P_L$), a timing when the pickup roller 33 is driven is determined such that a time $S_L$ which is the sum of a time period from the leading end of the previous sheet $P_L$ is detected to the trailing end of the sheet PL is detected (that is, the length $L_L$ of the sheet $P_L$ has passed) and a time period during which the sheet distance $D_L$ passes. After the leading end of the previously fed sheet $P_L$ is detected, by driving the pickup roller 33 at the above timing (i.e., after the elapse of the time period corresponding to the length $S_L=L_L+D_L$), the sheet distance $D_L$ can be maintained between the trailing end of the previously fed sheet FL and the leading end of the subsequently fed sheet $P_L$.

As shown in FIG. 3C, when the sheet P having A6 size is employed (such a sheet will be referred to a sheet $P_{A6}$), a timing when the pickup roller 33 is driven is determined such that a time $S_{A6}$ which is the sum of a time period from the leading end of the previous sheet $P_L$ is detected to the trailing end of the sheet $P_{A6}$ is detected (that is, the length $L_{A6}$ of the sheet $P_{A6}$ has passed) and a time period during which the sheet distance $D_{A6}$ passes. After the leading end of the previously fed sheet $P_{A6}$ is detected, by driving the pickup roller 33 at the above timing (i.e., after the elapse of the time period corresponding to the length $S_{A6}=L_{A6}+D_{A6}$), the sheet distance $D_{A6}$ can be maintained between the trailing end of the previously fed sheet $P_{A6}$ and the leading end of the subsequently fed sheet $P_{A6}$.

Incidentally, in actual use, a time period during which the leading end of the sheet P is fed from the sheet feed tray 31 to the sheet sensor 39 is subtracted from the time period SL described above to actuate the pickup roller 33.

The sheet distance $D_{A6}$ when the small size sheet $P_{A6}$ is used is greater than the sheet distance $D_L$ when the longer size sheet PL is used. As shown in FIG. 4, the axial length of the heat roller 61 is approximately the same as the width (i.e., length in right-and-left direction) of the sheet $P_L$ having the maximum size. Thus, if the sheet $P_L$ is used, the heat of the heat roller 61 is absorbed over its axial length by the sheet $P_L$, and there is no portion at which the temperature of the heat roller 61 is locally raised. In contrast, when the A6 size sheet $P_{A6}$ is used, since the width of the A6 size sheet $P_{A6}$ is much smaller than the axial length of the heat roller 61, the temperature of portions of the heat roller 61 which do not face the sheet $P_{A6}$ may be raised locally.

By increasing the sheet distance for the sheet P having a smaller width, the heat distribution in the axial direction is leveled due to heat transfer inside the heat roller 61, and the local elevation of the temperature can be suppressed.

Next, sheet feed control according to the embodiment will be described. In the following description, an expression "a sensor 39 is ON" means that the sensor 39 detects the passage of the leading end of the sheet P (i.e., change of the status of the sensor from OFF to ON), and an expression "the sensor is OFF" means that the sensor 39 detects the passage of the trailing end of the sheet P (i.e., change of the status of the sensor 39 from ON to OFF). Further, in the description below, a case where A4 size sheets $P_{A4}$ are accommodated in the sheet tray 31 and fed.

As shown in FIG. 5, when the print job is input to the laser printer 1 as the user operates the PC or operation unit 9, the print job judgment unit 12 judges whether the input job includes an instruction to execute the simplex print job or the duplex print job (S101). It should be noted that the print job also includes the sheet size information designated by the user.

When the input print job includes the instruction to execute the duplex print (S101: YES), the control unit 10 executes a duplex print feed/supply control (S400), which will be described later.

When the input print job includes the instruction to execute the simplex print (S101: NO), the drive controller 13 drives the pickup roller 33, separation roller 34 and feed rollers (feed roller 36 and register roller 37), so that the pickup roller 33 feeds the first sheet $P_{A4}$ (S110). The pickup roller 33 and the separation roller 34 rotate for a predetermined period so that the leading end of the sheet $P_{A4}$ is caught by the nip between the feed roller 36 and the register roller 37, and stops the same. Thereafter, the sheet $P_{A4}$ is fed by the roller 36 or 37, and the pickup roller 33 and the separation roller 34 are driven as the sheet $P_{A4}$ is fed.

When the sheet sensor 39 detects the leading end of the sheet $P_{A4}$ (S111: YES), the print job judging unit 12 judges whether the print job includes print data for a subsequent sheet $P_{A4}$ (S112). If the print job does not include the print data for subsequent pages (S112: NO), the drive controller 13 keeps driving the feed rollers 36 and 37 (S119) to feed the sheet PA4 to the image formation unit 4. Next, the image formation unit 4 executes an image formation on the sheet $P_{A4}$. When the trailing end of the sheet $P_{A4}$ passes through the sheet sensor 39 (S120: YES), feeding/supplying of the sheet $P_{A4}$ is terminated. The sheet $P_{A4}$ on which the image was formed is discharged on the discharge tray 22 by the feed roller 72 and the discharge roller 73.

If the print job includes the print data for a subsequent page (S112: YES), the control unit 10 controls she drive controller 13 to keep driving the feed roller 36 and the register roller 37 in order to feed the sheet $P_{A4}$ to the image formation unit 4. Further, the control unit 10 starts measuring the size of the sheet using the measuring unit 11 (S113). Thereafter, the control unit 10 judges whether the sheet sensor 39 detects the trailing end of the first sheet $P_{A4}$ within a predetermined time period (S114).

In the above description, the "predetermined period" is defined as a time period necessary for feeding the "small size" sheet (for example a B5 size sheet) at the feeding speed in the feed path. Such a "predetermined period" is stored in the storage 19 in advance. Therefore, if the sheet sensor 39 does not detect the trailing end of the first sheet $P_{A4}$ (S114: NO), the length of the sheet $P_{A4}$ that was firstly fed after the print job was input is longer than the preliminary defined "small size" sheet P.

It is defined that the sheet having a longer length than the B5 sheet is a "predetermined type of recording sheet" having substantially the same length of the maximum size sheet (i.e., a legal size sheet) that can be used in the laser printer 1.

If the length of the sheet $P_{A4}(1)$ firstly fed after the print job was input is not measured by the measuring unit within the predetermined period (S114: NO), the drive controller 13 controls the feed roller 36 and the register roller 37 to feed the sheet $P_{A4}$ until the sheet distance $D_L$ necessary for the maximum size sheet $P_L$ is obtained. Further, the drive controller 13 starts driving the pickup roller 33 to feed the second sheet $P_{A4}(2)$ (S116). Specifically, as shown in FIG. 3B, the drive controller 13 starts driving the pickup roller 33 when a time period necessary for obtaining the distance SL (the sum of the length LL of the sheet PL and the sheet distance DL) after the sensor 39 detects the leading end of the first sheet PA4(1). It should be noted that sheet distances corresponding to the various sheet sizes are stored in the storage 19 in advance.

In the embodiment, the length L from the leading end of the sheet accommodated in the sheet tray 31 to the sheet sensor 39 has a following relationship.

$$L > 356 - 279 + \text{sheet distance } D_L$$

where, 356 (mm) is the length of the legal size sheet, and 279 (mm) is the length of the letter size sheet. Thus, the length L is greater than the sheet distance D which is necessary when the letter size or A4 size sheet is used. That is, for the "predetermined type of sheet" having a relatively long length, the subsequent sheet is fed by the pickup roller 33 before, the trailing end of the previously fed sheet passes through the sheet sensor 39 (i.e., before the sheet size is measured). If the subsequent sheet is fed after the trailing end of the previously fed sheet passes through the sheet sensor 39, the number of such sheets which can be processed in a unit time period is reduced. Therefore, drive controller 13 assumes that the A4 size sheet $P_{A4}$ is the maximum size sheet $P_L$, regardless of the user-designated length of the sheet P which may be included in the print job, the subsequent sheet $P_{A4}(2)$ is fed.

When the sheet sensor 39 detects the trailing end of the fist sheet $P_{A4}$ (S117) 7: YES), the length $L_{A4}$ of the sheet $P_{A4}$ is measured (S118), which length is stored in the storage 19.

If the sheet sensor 39 detects the leading end of the second sheet $P_{A4}(2)$ after the trailing end of the sheet $P_{A4}$ has passed through the sheet sensor 39 (S130: YES), the print job judging unit 12 judges whether the input print job contains the subsequent page (i.e., information to be printed on the third sheet $P_{A4}$) in S121 (FIG. 6).

When there is another page (S131: YES), if the sheet length data (e.g., the sheet size designated by the user and contained in the print job) is available (S132: YES), and if the length of the designated sheet P is greater than the measured sheet length (S133: YES), the drive controller 13 retrieves the designated sheet size and the necessary sheet distance (e.g., for the A4 size sheet: $L_{A4}$ and $D_{A4}$) from the storage 19 (S134), and drives the pickup roller 33 (S136) to feed the subsequent sheet P after a time period for feeding the sheet by the amount $S_{A4}$ which is the sum of $L_{A4}$ and $D_{A4}$.

If the user does not designate the sheet size (S132: NO), or the designated sheet length is not greater than the measured sheet length (S135: NO), the drive controller 13 retrieves the measured sheet length and the sheet distance necessary for the sheet (e.g., for the A4 size sheet $P_{A4}$, $L_{A4}$ and $D_{A4}$), and after elapse of a time period for feeding the sheet by the amount SA4 which is the sum of LA4 and DA4 (S135: YES), the drive controller 13 starts rotating the pickup roller 33 (S136). The above control may be modified such that steps S132 to S134 are omitted and, and starts the roller 33 to rotate (S136) regardless of the designated sheet size, but based on the measured sheet length and the sheet distance necessary for the sheet distance (S135: YES), With the above control, the pickup roller 33 feeds the third sheet $P_{A4}(3)$. Therefore, between the trailing end of the second sheet $P_{A4}(2)$ and the leading end of the third sheet $P_{A4}(3)$, the necessary sheet distance $D_{A4}$ can be obtained.

After the trailing end of the second sheet $P_{A4}(2)$ passes through the sheet sensor 39 (S137: YES) and the leading end of the third sheet $P_{A4}(3)$ also passes through the sheet sensor 39 (S130: YES), the control unit 10 repeats steps S130-S137 until the subsequent page becomes unavailable. As above, the control unit 10 feeds the second sheet $P_{A4}(2)$ by determining sheet size of the first fed sheet $P_{A4}$ and the sheet distance $D_L$ between the first an second sheets on assumption that the first sheet has the maximum size. After the length $L_{A4}$ of the sheet $P_{A4}$ has been measured, the third sheet $P_{A4}(3)$ and the subsequent sheets are fed at timings corresponding to the measured length $L_{A4}$.

If there are no subsequent pages (S131: NO), the control unit 10 feeds the last sheet to the image formation unit 4 (see S112 and S119) in S138. After the trailing end of the sheet passes through the sheet sensor 39 (S139: YES), the control unit 10 terminates the sheet feed/supply operations.

When the sheet has the legal size, as shown in FIG. 3A, the second sheet $P_L(2)$ is fed based on the assumed sheet length $L_L$ and the corresponding sheet distance $D_L$, and the third sheet $P_L(3)$ and subsequent sheets are fed based on the measured (or designated) sheet length $L_L$ and the corresponding sheet distance $D_L$. When the sheet has the letter size, the second sheet is fed based on the assumed sheet length $L_L$ and the corresponding sheet distance $D_L$, and the third and subsequent sheets are fed based the measured (or designated) sheet length and the corresponding sheet distance necessary for the sheet.

As described above, for the "predetermined type of sheets" having a relatively long length and accommodated in the sheet tray 31, if the length of the first sheet P is not measured by the measuring unit 11 within a predetermined period, the control unit 10 feeds the second sheet P with the same timing when the maximum size sheet PL is subsequently fed, regardless of the size designated by the user. Therefore, the necessary sheet distance can be obtained. With this configuration, the first sheet P and the second sheet P do not overlap within the feed path 38, and jam or blurring of the image can be suppressed.

According to the embodiment, the sheet sensor 39 is provided on the immediate rear side of the register roller 37, in the sheet feed direction, the sheet size can be measured accurately. If the sheet sensor 39 is arranged on the upstream side of the register roller 37, as the sheet P once stops when it contacts the register roller 37, therefore the sheet size may be measured to be slightly longer than the actual size. However, according the embodiment, the sheet P detected by the sheet sensor 39 does not stop during the measurement. Therefore, the length of the sheet P can be measured accurately.

Next, the sheet feed control of the small size sheet (e.g., A6 size sheet $P_{A6}$), which is not the "predetermined type of sheet," will be described.

In S114 (FIG. 5), when the sheet sensor 39 detects the trailing end of the first sheet $P_{A6}$ within a predetermined period (S114: YES), the length of the sheet $P_{A6}$ that was firstly fed after the print job was input is measured (S211), the measured length being stored in the storage 19.

As in steps S132-S136, if there is data of the sheet size designated by the user (e.g., which may be contained in the print job) (S212: YES), and the designated sheet size (length) is greater than the measured sheet length (S213: YES), the drive controller 13 retrieves the designated sheet size and necessary sheet distance (e.g., for the A6 size sheet, $L_{A6}$ and $D_{A6}$) from the storage 19, and, after a period necessary for feeding the sheet by the distance $S_{A6}(=L_{A6}+D_{A6})$ is elapsed (S216), the drive controller 13 starts rotating the pickup roller 33 (S216).

If the user has not designated the size of the sheet P (S212: NO), or if the designated sheet size is not greater than the measured length (S213: NO), the drive controller 13 retrieves the measured sheet length and the sheet distance necessary for the sheet (e.g., for the A6 sheet $P_{A6}$, $L_{A6}$ and $D_{A6}$) from the storage 19, and after elapse of the time for feeding the sheet $P_{A6}$ by the amount of $S_{A6}(=L_{A6}+D_{A6})$ (S215: YES), the drive controller 13 starts rotating the pickup roller 33 (S216). The above process can be modified such that the steps S212-S214 are mitted, and the pickup roller 33 is started (S216) based on the measured sheet length and the sheet distance necessary for the sheet, regardless of the designated sheet size.

The pickup roller 33 feeds the second sheet $P_{A6}$ as described above. Therefore, between the trailing end of the first sheet $P_{A6}$ and the leading end of the second sheet $P_{A6}$, the necessary sheet distance $D_{A6}$ corresponding to the sheet size (A6) can be obtained.

After feeding the second sheet $P_{A6}$ (S217: YES), if the input print job contains the subsequent page (i.e., the print data to be printed on the third sheet $P_{A6}$) (S218: YES), the control unit 10 repeats the steps S212 to S218 until the all the information is printed. As above, in the sheet feed/supply control of small size sheet, the control unit 10 feeds the second sheet $P_{A6}$ and onwards at a timing based on the length LA6 and the sheet distance $D_{A6}$.

If there is no subsequent page (S218: NO), the control unit 10 feeds the last sheet PA6 to the image formation unit 4 (S219). When the trailing end of the sheet PA6 passes through the sheet sensor 39 (S200: YES), the control unit terminates the sheet feed/supply process.

As described above, according to the small size sheet feed/supply process, when the length A6 of the first sheet $P_{A6}$ is measured by the measuring unit 11 within a predetermined period, the control unit 10 feeds the second sheet $P_{A6}$ at a timing corresponding to the measured length $L_{A6}$ and sheet distance $D_{A6}$, it becomes possible to feed the sheets PA6 with a constant sheet distance $D_{A6}$ maintained.

Next, the sheet feed/supply control when the duplex printing is executed. In the following description, a case where the A4 size sheet is used will be described.

In S101 (FIG. 5), if the input print job contains an instruction to execute the duplex printing to form images on both sides of the printing sheet (S101: YES), as shown in FIG. 8, the drive controller 13 first drives the pickup roller 33, separation roller 45, feed roller 36 and register roller 37 to feed the first sheet $P_{A4}$ from the sheet tray 31 (S411).

Next, when the sheet sensor 39 turns ON (S412: YES), the measuring unit 11 starts measuring the sheet length (S413), and finish measuring the sheet length (S415) when the sheet sensor 39 turns OFF (S414: YES). The control unit 10 stores the measured sheet length in the storage 19.

When the leading end of the sheet $P_{A4}$ reaches the image formation unit 4, the controller of the image formation unit 4 executes a printing operation to print an image on one side of the sheet $P_{A4}$. Then, the feed roller 72, the discharge roller 73 and the feed roller 82 are controlled to reverse the front/back surfaces of the sheet $P_{A4}$, and feeds the leading end of the reversed sheet $P_{A4}$ to the register roller 37. The drive controller 13 then drives the register roller 37 to feed the sheet $P_{A4}$ to the sheet sensor 39 and the image formation unit 4, again.

When the sheet sensor 39 detects the leading end of the first sheet $P_{A4}$ with its back surface turned upward (S416: YES), the image formation unit 4 starts operating to print an image on the back surface of the sheet PA4. At this stage, the print job judgment unit 12 judges whether the input print job contains a subsequent page (S417).

If there is a subsequent page (S417: YES), the drive controller 13 retrieves the designated sheet size and the sheet distance for the sheet size (for the A4 sheet $P_{A4}$, $L_{A4}$ and $D_{A4}$) from the storage 19 if there is data of the user designated sheet size, or the sheet length data (such data may be contained in the print job) (S418: YES), the if the length of the designated sheet P is greater than the measured sheet length (S419: YES), as in S312-S136 described above. Then, the drive controller 13 starts driving the pickup roller 33 (S411) in order to feed the subsequent sheet after the time period for feeding the sheet by the amount $S_{A4}(=L_{A4}+D_{A4})$.

If the user has not designated the sheet size (S418: NO) or if the length of the designated sheet is not greater than the measured sheet length (S418: NO), the drive controller 13 retrieves the measured sheet length and the sheet distance corresponding to the measured sheet length (for A4 sheet $P_{A4}$, $L_{A4}$ and $D_{A4}$) from the storage 19, and starts driving the pickup roller 33 in order to feed the subsequent sheet (S420). Incidentally, the steps S418 to S420 may be omitted and the steps S421 and S420 may be executed regardless of the designated sheet size.

The control unit 10 executes the above steps until the subsequent page is not output (i.e., there is no data for the subsequent page) (S417: NO). Incidentally, measurement of the sheet length (S413 and S415) may be omitted for the second sheet onward. For the duplex printing, the measurement of the sheet length has been finished before the second sheet PA4 is fed. The drive controller 13 feeds the second or later sheet PA4 with the appropriate sheet distance corresponding to the measured sheet length.

In S417, if there is no more pages (S417: NO), the control unit 10 feeds the sheet toward the image formation unit 4 (S419), and terminates the sheet feed/supply operation. Thereafter, the image formation unit 4 and the feed roller 72, the discharge roller, the feed roller 82 are controlled so that the image is formed on the back surface of the sheet PA4, which is discharged on the discharge tray 22.

It should be noted that the invention does not need to be limited to the configuration of the exemplary embodiment described above, but can be modified in various way without departing from the scope of the invention.

For example, in the above-described exemplary embodiment, the sheet sensor is arranged immediate after, of the register roller, in the sheet feed direction. Such a configuration may be modified such that the sheet detector may be arranged in immediate front of the register roller.

As the sheet sensor 39, various types of well-known detection sensor may be used. Such a detection sensor may include an optical sensor having a light emitter and a light receiver facing each other, one that detects presence/absence (passage) magnetically, or one that detects presence/absence (passage) based on change of electrostatic capacity.

As a sheet accommodation unit, in addition to the sheet tray 31 which is arranged at a lower portion of the housing 2, various trays such as a manual insertion tray provided on a front face or a top face of the housing may be employed.

A variable range of the "predetermined type of sheet" that has substantially the same length as the maximum sheet employable in the image formation device may be determined arbitrarily in relation to the length of a feed path from the sheet accommodation unit to the sheet detection unit.

The image formation unit 4 does not need to be limited to one employing the scanning laser beam. One employing the LED instead of the laser beam may be employed for the electrophotographic image formation method. Alternatively, as the image formation unit 4, one according to the thermal transfer method, inkjet method, and the like can also be employed.

The invention does not need to be limited to the image formation device having only the image forming function. Instead, the invention is applicable to various devices having one or more functions in addition to the image formation function,

What is claimed is:

1. An image formation device comprising:

a sheet accommodation unit configured to accommodate a plurality of sheets;

an image formation unit configured to form an image on one or more of the plurality of sheets accommodated in the sheet accommodation unit;

a sheet feed mechanism configured to feed the plurality of sheets accommodated in the sheet accommodation unit one by one toward the image formation unit with a variable distance between a trailing end of a previously fed sheet and a leading end of a subsequently fed sheet;

a sheet detection unit configured to detect absence or presence of a sheet fed by the sheet feed mechanism to the image formation unit;

a feed path that guides the plurality of sheets fed one by one by the sheet feed mechanism to the image formation unit, wherein:

the sheet detection unit is provided to the feed path, and a length of the feed path from the sheet accommodation unit to the sheet detection unit is greater than the variable distance corresponding to a predetermined type sheet having a maximum length on which the image formation unit is configured to form an image; and a controller configured to execute:

controlling the sheet feed mechanism to feed a first sheet of the plurality of sheets accommodated in the sheet accommodation unit toward the image formation unit along the feed path in response an image formation instruction;

starting measurement of a sheet length of the first sheet, wherein measurement of the sheet length of the first sheet is based on movement of the first sheet and the absence or presence of the first sheet detected by the sheet detection unit;

judging whether measurement of the sheet length of the first sheet has been completed within a predetermined period or has not been completed within the predetermined period;

when the controller judges that measurement of the sheet length of the first sheet has not been completed within the predetermined period, setting a first predetermined distance, the first predetermined distance corresponding to the predetermined type sheet having the maximum length, as the variable distance between a trailing end of the first sheet and a leading end of a second sheet of the plurality of sheets accommodated in the sheet accommodation unit to be fed by the sheet feed mechanism, and controlling the sheet feed mechanism to feed the second sheet, before the measurement of the sheet length of the first sheet is completed, with the first predetermined distance as the variable distance between the trailing end of the first sheet and the leading end of the second sheet; and when the controller judges that measurement of the sheet length of the first sheet has been completed within the predetermined period, setting a second predetermined distance, the second predetermined distance being different from the first predetermined distance, as the variable distance between the trailing end of the first sheet and the leading end of the second sheet of the plurality of sheets accommodated in the sheet accommodation unit to be fed by the sheet feed mechanism, and controlling the sheet feed mechanism to feed the second sheet, after the measurement of the sheet length of the first sheet is completed, with the second predetermined distance as the variable distance between the trailing end of the first sheet and the leading end of the second sheet.

2. The image formation device according to claim 1, wherein the controller is further configured to execute setting one of:

a third predetermined distance corresponding to the measured sheet length of the first sheet, and a fourth predetermined sheet distance corresponding to a sheet length designated by an user, as the variable distance between a trailing end of the second sheet and a leading end of a third sheet of the plurality of sheets accommodated in the sheet accommodation unit to be fed by the sheet feed mechanism.

3. The image formation device according to claim 1, wherein the controller is further configured to execute, when the controller judges that measurement of the sheet length of the first sheet has been completed within the predetermined period, setting one of:

a third predetermined distance corresponding to the measured sheet length of the first sheet, and a fourth predetermined distance corresponding to a sheet length designated by an user, as the variable distance between a trailing end of the second sheet and a leading end of a third sheet of the plurality of sheets accommodated in the sheet accommodation unit to be fed by the sheet feed mechanism.

4. The image formation device according to claim 1, wherein the sheet feed mechanism comprises:

a pickup roller, and a feed roller arranged downstream of the pickup roller, wherein the pickup roller is configured to contact a sheet accommodated in the sheet accommodation unit to be fed toward the feed roller, and to feed the sheet toward the feed roller, wherein the feed roller is configured to feed the sheet fed from the pickup roller toward the image formation unit, and wherein the pickup roller is configured to be controlled to stop independently of the feed roller, and wherein the control unit is further configured to execute:

stopping the pickup roller from contacting and feeding the subsequently fed sheet toward the feed roller after it becomes possible for the feed roller to feed the previously fed sheet fed from the pickup roller, and restarting the pickup roller such that the subsequently fed sheet is fed to provide the variable distance between the trailing end of the previously fed sheet and the leading end of the subsequently fed sheet.

5. The image formation device according to claim 4, wherein the sheet feed mechanism further comprises a register roller configured to regulate a movement of the leading end of the sheet fed from the feed roller and to feed the sheet toward the image formation unit, wherein the detection unit is arranged on one of an immediate upstream side and an immediate downstream side, in a sheet feed direction, of the register roller.

6. The image formation device according to claim 1, further comprising a reverse path configured to guide the first sheet discharged from the image formation unit toward the image formation unit from the feed path at a position on an upstream side with respect to the sheet detection unit in a reversed state, wherein, when an input image formation instruction instructs duplex printing, after the first sheet reaches the sheet detection unit from the reverse path, the controller is further configured to execute:

setting one of a third predetermined distance corresponding to the measured sheet length of the first sheet and a fourth predetermined distance corresponding to a sheet length designated by an user as the variable distance between a trailing end the first sheet undergoing duplex printing and the leading end of the second sheet to be fed by the sheet feed mechanism.

7. The image formation device according to claim 1, wherein the controller is further configured to execute:

when the controller judges that measurement of the sheet length of the first sheet has been completed within the predetermined period, further judging whether a sheet length has been designated by an user or has not been designated by the user;

when the controller judges that a sheet length has been designated by the user, further judging whether the designated sheet length is longer than the measured sheet length or shorter than the measured sheet length, setting the second predetermined distance based on whether the designated sheet length is longer than the measured sheet length or shorter than the measured sheet length, and setting a third predetermined distance, based on whether the designated sheet length is longer than the measured sheet length or shorter than the measured sheet length, as the variable distance between the trailing end of the second sheet and the leading end of a third sheet of the plurality of sheets accommodated in the sheet accommodation unit to be fed by the sheet feed mechanism, and controlling the sheet feed mechanism to feed the third sheet with the third predetermined distance as the variable distance between the trailing end of the second sheet and the leading end of the third sheet; and when the controller judges that a sheet length has not been designated by the user, further setting the second predetermined distance to correspond to the measured sheet length, setting a fourth predetermined distance, the fourth predetermined distance corresponding to the measured sheet length, as the variable distance between the trailing end of the second sheet and the leading end of the third sheet of the plurality of sheets accommodated in the sheet accommodation unit to be fed by the sheet feed mechanism, and controlling the sheet feed mechanism to feed the third sheet with the fourth predetermined distance as the variable distance between the trailing end of the second sheet and the leading end of the third sheet.

8. The image formation device according to claim 1, wherein the controller is further configured to execute:

when the controller judges that measurement of the sheet length of the first sheet has not been completed within the predetermined period, further judging whether a sheet length has been designated by an user or has not been designated by the user;

setting a third predetermined distance based on whether a sheet length has been designated by the user or has not been designated by the user, as the variable distance between the trailing end of the second sheet and the leading end of the third sheet of the plurality of sheets accommodated in the sheet accommodation unit to be fed by the sheet feed mechanism, and controlling the sheet feed mechanism to feed the third sheet with the third predetermined distance as the variable distance between the trailing end of the second sheet and the leading end of the third sheet.

9. The image formation device according to claim 1, wherein the controller is further configured to execute:

when the controller judges that measurement of the sheet length of the first sheet has not been completed within the predetermined period, and the sheet length of the first sheet is measured to be the maximum length, setting the first predetermined distance as the variable distance between a trailing end of the second sheet and a leading end of a third sheet of the plurality of sheets accommodated in the sheet accommodation unit to be fed by the sheet feed mechanism, and controlling the sheet feed mechanism to feed the third sheet with the first predetermined distance as the variable distance between the trailing end of the second sheet and the leading end of the third sheet; and when the controller judges that measurement of the sheet length of the first sheet has not been completed within the predetermined period, and the sheet length of the first sheet is measured to be less than the maximum length, setting a third predetermined distance that is different from the first predetermined distance, as the variable distance between the trailing end of the second sheet and the leading end of the third sheet of the plurality of sheets accommodated in the sheet accommodation unit to be fed by the sheet feed mechanism, and controlling the sheet feed mechanism to feed the third sheet with the third predetermined distance as the variable distance between the trailing end of the second sheet and the leading end of the third sheet.

* * * * *